United States Patent [19]

Rineman

[11] 3,985,090

[45] Oct. 12, 1976

[54] SPORT BOAT

[75] Inventor: Richard Lynn Rineman, Brighton, Mich.

[73] Assignees: Harold J. Rineman, Southfield; S. Albert Young, Birmingham, both of Mich. ; part interest to each

[22] Filed: June 5, 1975

[21] Appl. No.: 584,124

[52] U.S. Cl. ..... 114/39; 114/123; 114/163

[51] Int. Cl.[2] ..... B63H 9/04

[58] Field of Search ..... 114/39, 61, 123, 102, 114/163, 66.5 F, 219; 9/310 E

[56] References Cited

UNITED STATES PATENTS

| | | | |
|---|---|---|---|
| 1,361,902 | 12/1920 | Porteous | 114/219 |
| 2,944,505 | 7/1960 | Berge | 114/39 |
| 3,173,395 | 3/1965 | Laurent | 114/102 |
| 3,223,064 | 12/1965 | White | 114/39 |
| 3,223,065 | 12/1965 | Wilson, Jr. | 114/123 |
| 3,259,093 | 7/1966 | Taylor | 114/39 |
| 3,336,890 | 8/1967 | Laurent | 114/123 |
| 3,455,261 | 7/1969 | Perrin | 9/310 E |

*Primary Examiner*—Stephen G. Kunin
*Assistant Examiner*—Stuart M. Goldstein
*Attorney, Agent, or Firm*—Benjamin W. Colman

[57] ABSTRACT

A wind-propelled sailboat having a main hull and an outboard pontoon or outrigger, a mast mounted upon the main hull and a sail removably connected to the top of the mast, the sail being controlled for propulsion of the boat by a manually manipulated lever sheet-connected to the sail, and manually controlled rudder means for primary steering of the boat.

27 Claims, 12 Drawing Figures

SPORT BOAT

BACKGROUND OF THE INVENTION

The art to which the invention relates is that of sailboats preferably designed for use and operation by a single person, although by suitable modification the boat can be arranged to accommodate more than one person.

Prior art sailboats having a generally outboard pontoon arrangement normally have the mast and sail positioned substantially medially on a platform section supported upon and between two lateral parallel pontoons, with a swinging boom connected at one of its ends to the lower portion of the mast, the sail extending substantially horizontally rearwardly for control by the operator manipulating conventional sheet line systems. Some of these sailboats also have jib-type sails ahead of and connected to the mainmast or foremast.

Another type sailboat is that disclosed in Schweitzer et al U.S. Pat. No. 3,487,800 entitled "Wind-Propelled Apparatus", in which the mast for a sail is universally mounted substantially medially and central of a surfboard, with a pair of booms disposed substantially medially about and on either side of the sail so that the person standing on the surfboard can position himself on either side of the sail as may be required, to grasp the boom and thus support the mast and sail. By grasping the boom, the operator permits the sail to swing into the wind, controlling its attitude and thereby the direction of the surfboard. In the event that the force of the wind should be overwhelming, the operator can release his grasp on the boom, allowing the sail and mast to fall away at the universal fitting on which the mast is mounted and into the water.

SUMMARY OF THE INVENTION

The present invention relates to a sailboat having an outboard pontoon with an intermediate web and platform section between the main hull and the outboard pontoon, a sail mast being positioned substantially medially and to one side of the main hull and supporting from its upper end a sail having a boom extending across the bottom of the sail, the main hull having rudders at each end which are controlled for direction by steering mechanism manually operated by the sailor normally standing on the web and platform section, a sheet-line system connected to the sail boom and to a sail control lever manually manipulated by the sailor for swinging the sail from its peak adjacent the top of the mast into desired wind-propelled sailing postures to one side or other of the mast.

The sailor operating the boat normally stands, or he may kneel or sit, on the platform web section, grasping the handle of a rudder control rod by one hand and a sail control lever with his other hand, to steer the boat in the desired direction. The rudder control rod is pivotally mounted for vertical movement upon a shaft having a rudder control lever affixed to its distal end. Cables connected to this lever and to rudder pivot levers, within the main hull, simultaneously rotate rudder shafts and their attached rudders in opposite directions.

Lines or sheets are connected to each end of the sail control lever and extend through blocks, or other suitable fittings, to the sail boom and from each end thereof to a carrier slidably mounted on a rod or slide guide affixed to the main hull adjacent and extending to either side of the mast.

The sail is generally parabolic in shape, the apex of the sail being normally elevated to or adjacent the top of the mast for the sailing function.

Steering of the boat is effected primarily by the rudders and their control mechanism, supplemented by the sail and its control system for establishing the general direction of the boat, i.e., to the left or to the right of the sailor as he faces the mast.

DRAWINGS

Various further and more specific objects, features and advantages of the invention will appear from the description given below, taken in connection with the accompanying drawings, illustrating by way of example a preferred form of the invention. Reference is here made to the drawings annexed hereto and forming an integral part of this specification, in which FIG. 1 is a perspective view of a preferred embodiment of the invention.

Figure 2:
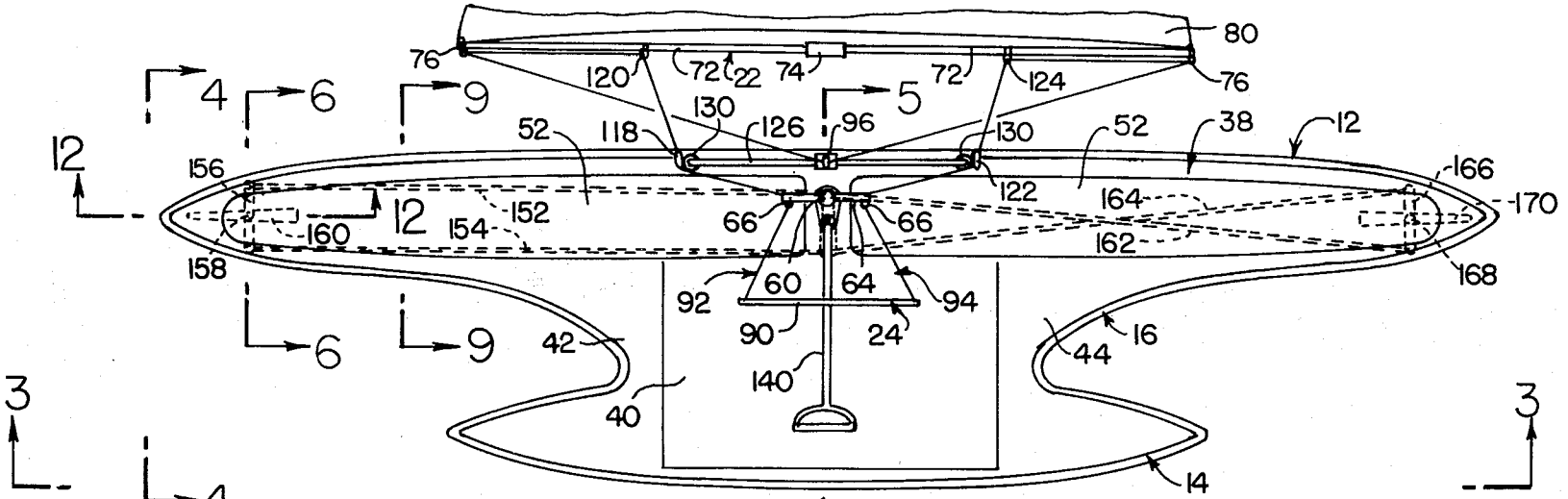
FIG. 2 is a top plan view of the sailboat embodiment illustrated in FIG. 1, the sail being shown fragmentarily.
Figure 5:
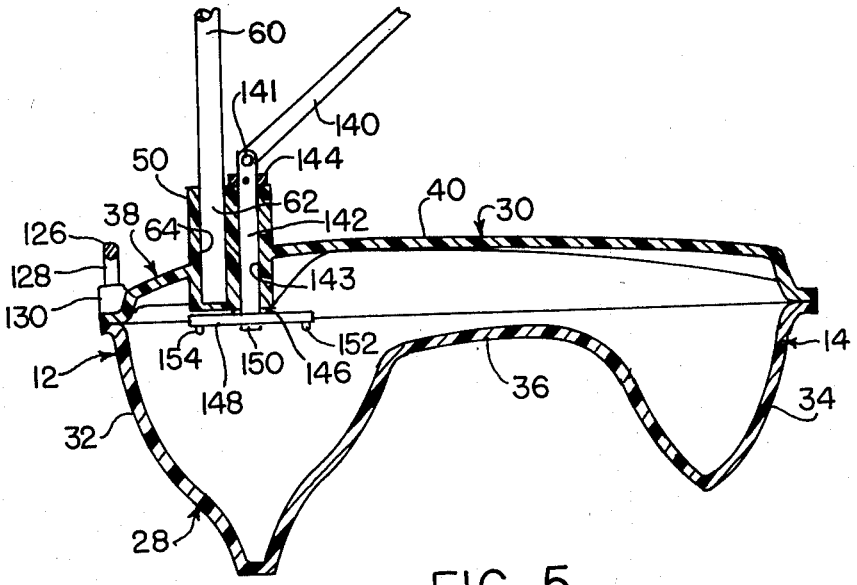
Figure 4:
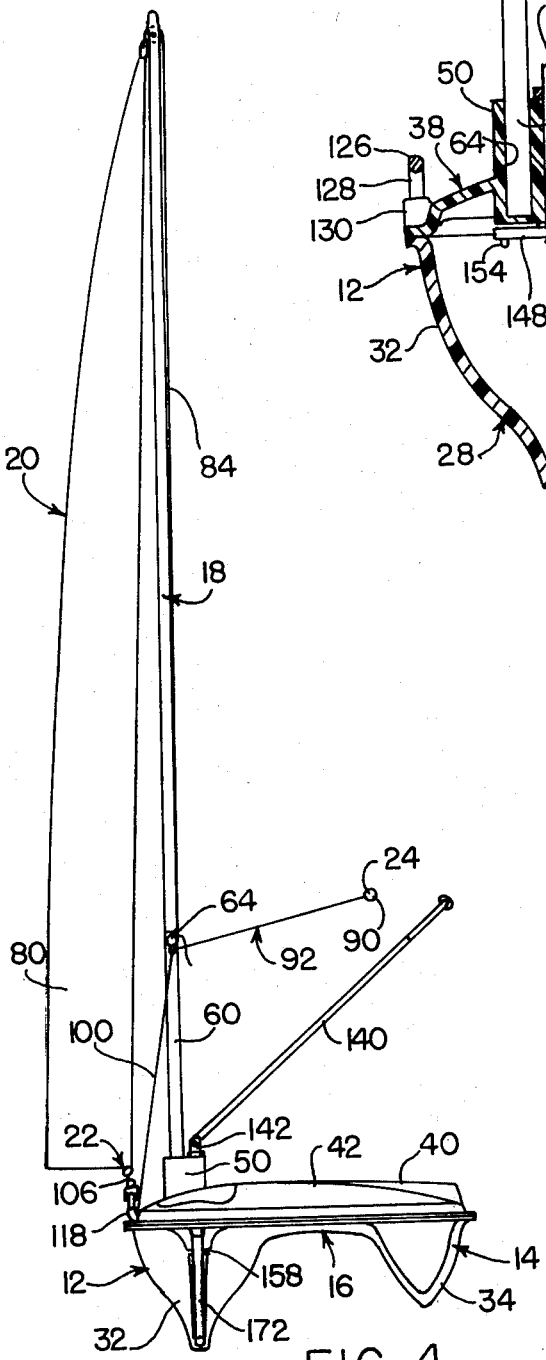
FIG. 4 is an end elevational view taken substantially on the line 4—4 of FIG. 2.
Figure 6:
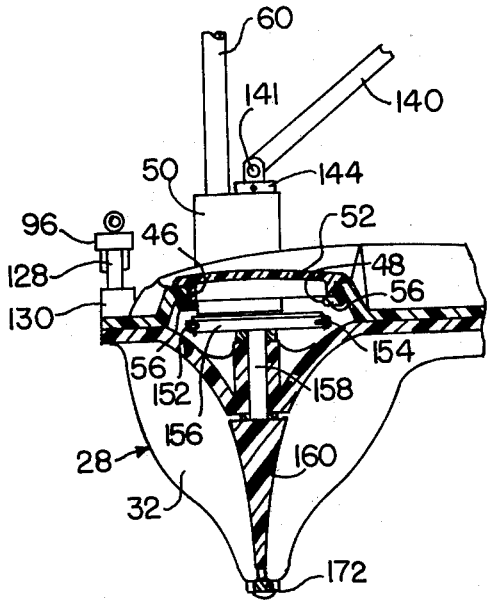

FIGS. 5 and 6 are vertical sectional views, taken substantially on the lines 5—5 and 6—6 of FIG. 2.

Figure 7:
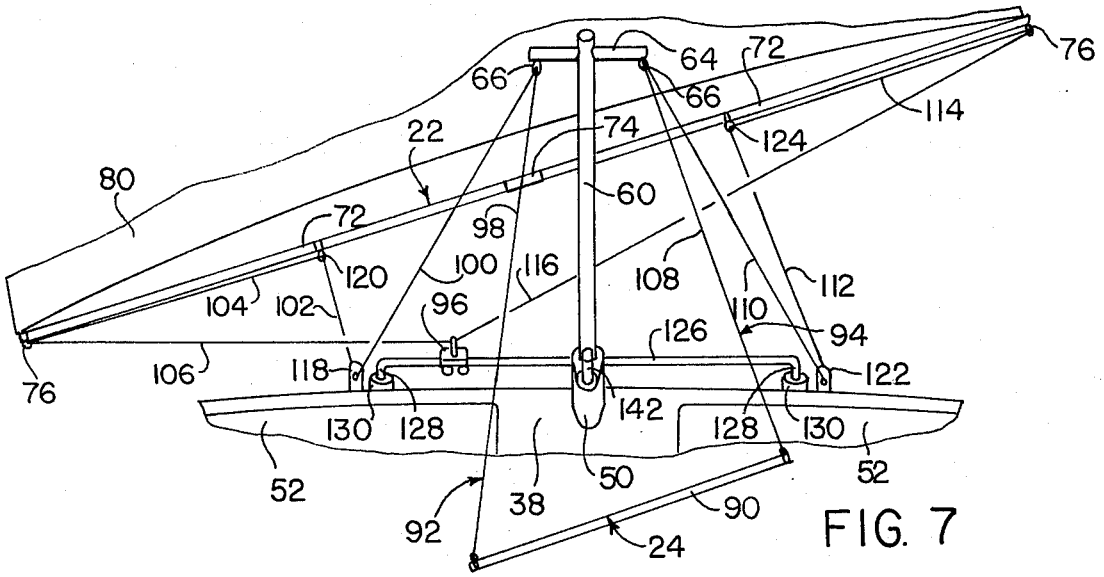
Figure 8:
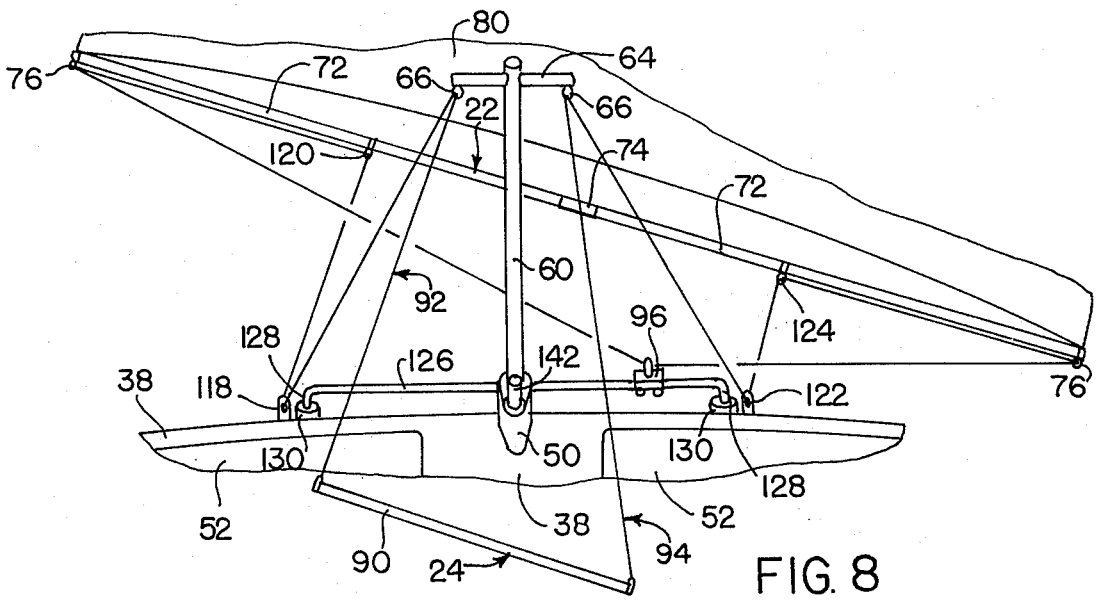

FIGS. 7 and 8 are fragmentary perspective views showing the attitudes of the sail and its boom, with respect to the mast, as the sail control lever is rotated in a counterclockwise or clockwise direction respectively.

Figure 9:
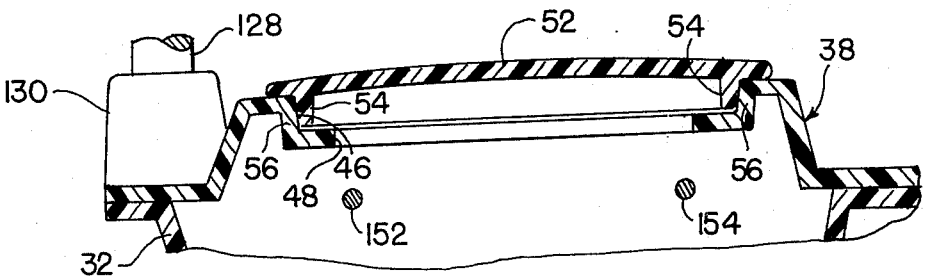

FIG. 9 is a fragmentary vertical sectional view taken substantially on the line 9—9 of FIG. 2.

Figure 10:
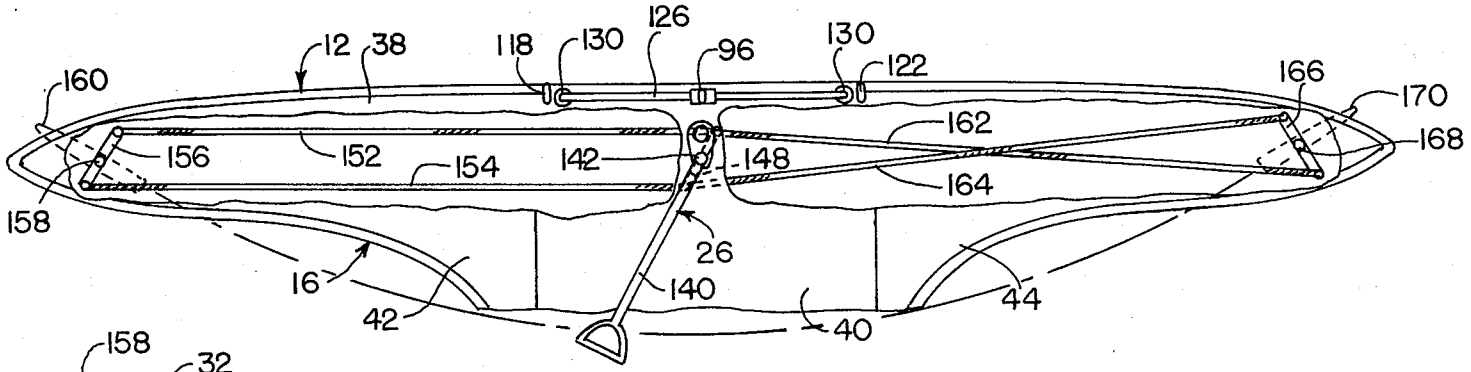
Figure 11:
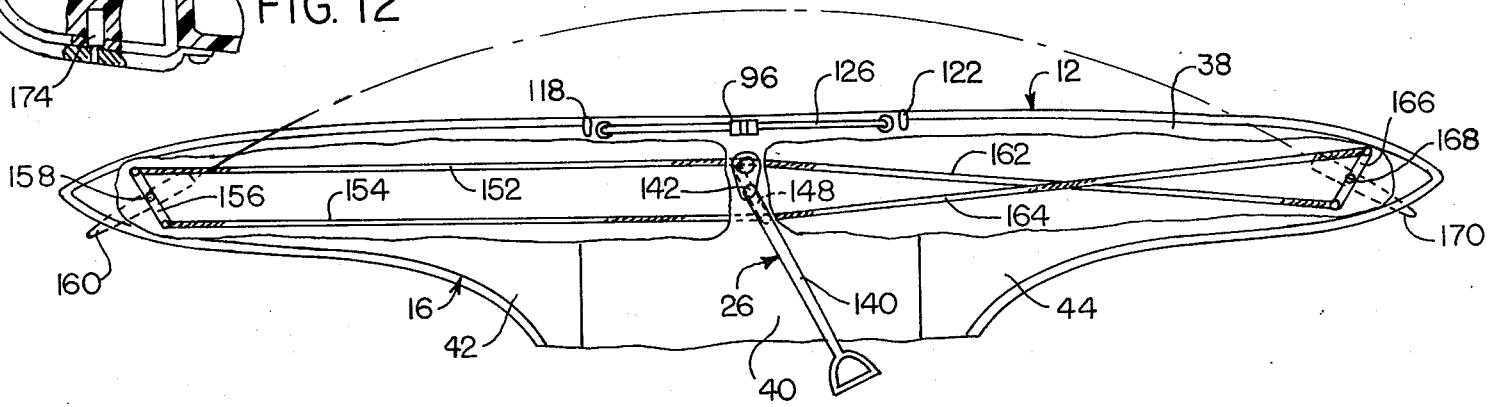

FIGS. 10 and 11 are fragmentary top plan views of the main hull, with portions cut away, showing the attitudes of the rudders as the rudder control lever is rotated in a clockwise or counter-clockwise direction respectively.

Figure 3:
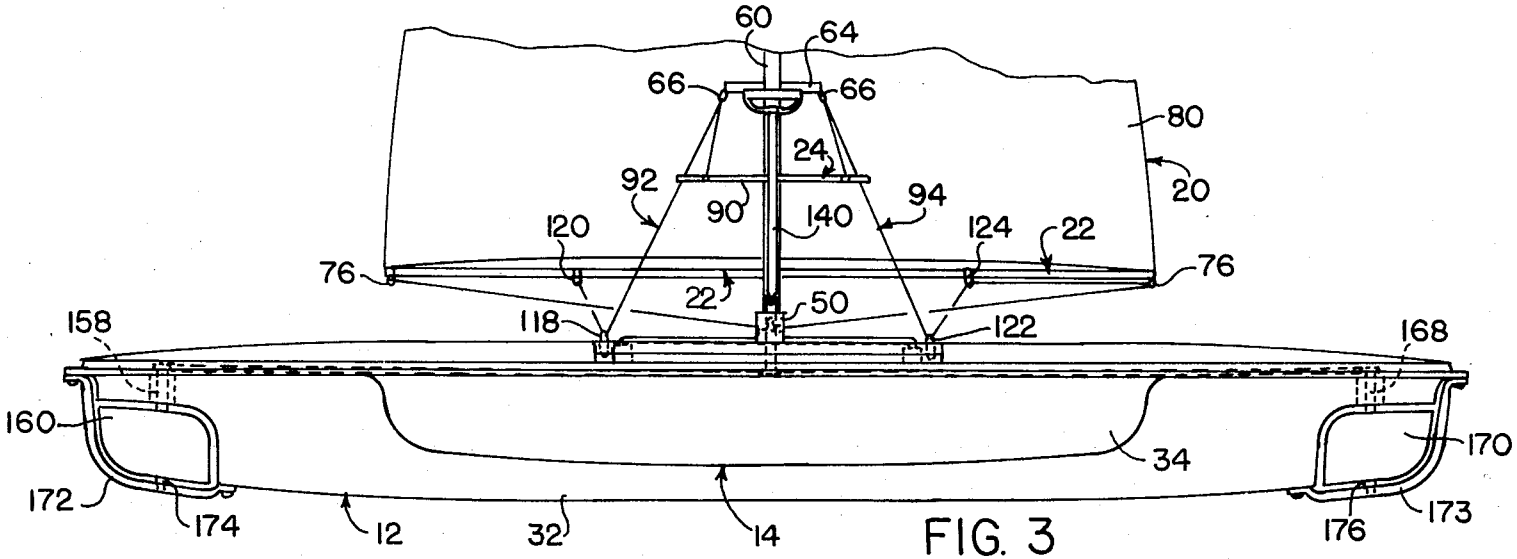
FIG. 3 is a side elevational view taken substantially on the line 3—3 of FIG. 2.
Figure 12:
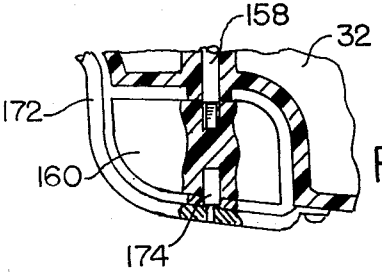

FIG. 12 is a vertical sectional view through the rudder portion of the main hull, at the left end thereof as shown in FIG. 3.

A DESCRIPTION OF THE PREFERRED EMBODIMENT

A preferred embodiment of the invention, illustrated in the several drawings annexed hereto, comprises the boat device 10 having a main hull 12 and an outboard pontoon or outrigger 14 connected by an intermediate web and platform section 16, a mast 18 stepsupported upon the main hull 12, a sail 20 connected to the mast at or adjacent its top and having a boom 22 connected to the lower portion of the sail and controlled as to its attitude by lines or sheets connected to a manually manipulated sail control lever 24, and a manually operable rudder control mechanism 26.

The main hull 12, the outboard pontoon or outrigger 14 and the intermediate connecting web and platform section 16 are preferably made in two molded plastic parts, a lower section 28 and an upper section 30 (FIG. 5). The lower section 28 comprises the main hull underbody 32, the outboard pontoon underbody 34 and the intermediate connecting underbody 36 of the web section 16. The upper section 30 comprises the main hull portion 38, the operating web platform portion 40 and its adjacent lateral portions 42 and 44. The main hull upper portion 38 is provided with two longitudinally extending recesses 46 and openings 48, which commence adjacent but spaced apart from the mast step 50 secured to and positioned medially of the main hull upper portion 38 therebetween and which extend substantially to each end of the main hull. The recesses 46 and openings 48 are covered with plate members 52,52 that seat themselves in the recesses and have depending flanges 54,54 adapted to fit snugly and firmly within each recess 46. These openings 48,48 provide access to the chamber formed by the main hull underbody section 28 and the main hull upper section 38. Each longitudinally extending recess 46 is defined by the L-section flanges 56,56, the distal edges of which define each opening 48.

The upper body web area portions 42,44 adjacent the intermediate platform portion 40 cover and overlie the underbody 34 of the outboard pontoon and the intermediate web underbody 36. The lower section 28 and the upper section 30 of the boat body, when conjoined together, define a chamber therebetween which can be air filled, empty, or optionally filled with a low density foam-type plastic or other composition material, to provide buoyancy for the boat. These plastic molded sections are conjoined at their peripheral edges by fusion under heat and pressure or by cementation, means and processes well known in the art. Optionally, the boat body sections can be made of metal by stamping or other conventional processing, and secured together by fasteners or other suitable means.

When made of plastic materials, the lower section 28 and the upper section 30 of the boat body, and the cover plates 52,52, can each be integrally formed of a suitable plastic or composition material in molds. Each of these members can also be made in segments that are fused or cemented together, whereby very large molds are not required. The materials and methods of manufacture and assembly are conventional in the art and have long been practiced by persons skilled in the art to which the invention pertains. No claim is made in this application to any particular material, method or process for fabricating the boat described herein as a preferred embodiment of the invention.

Figure 1:
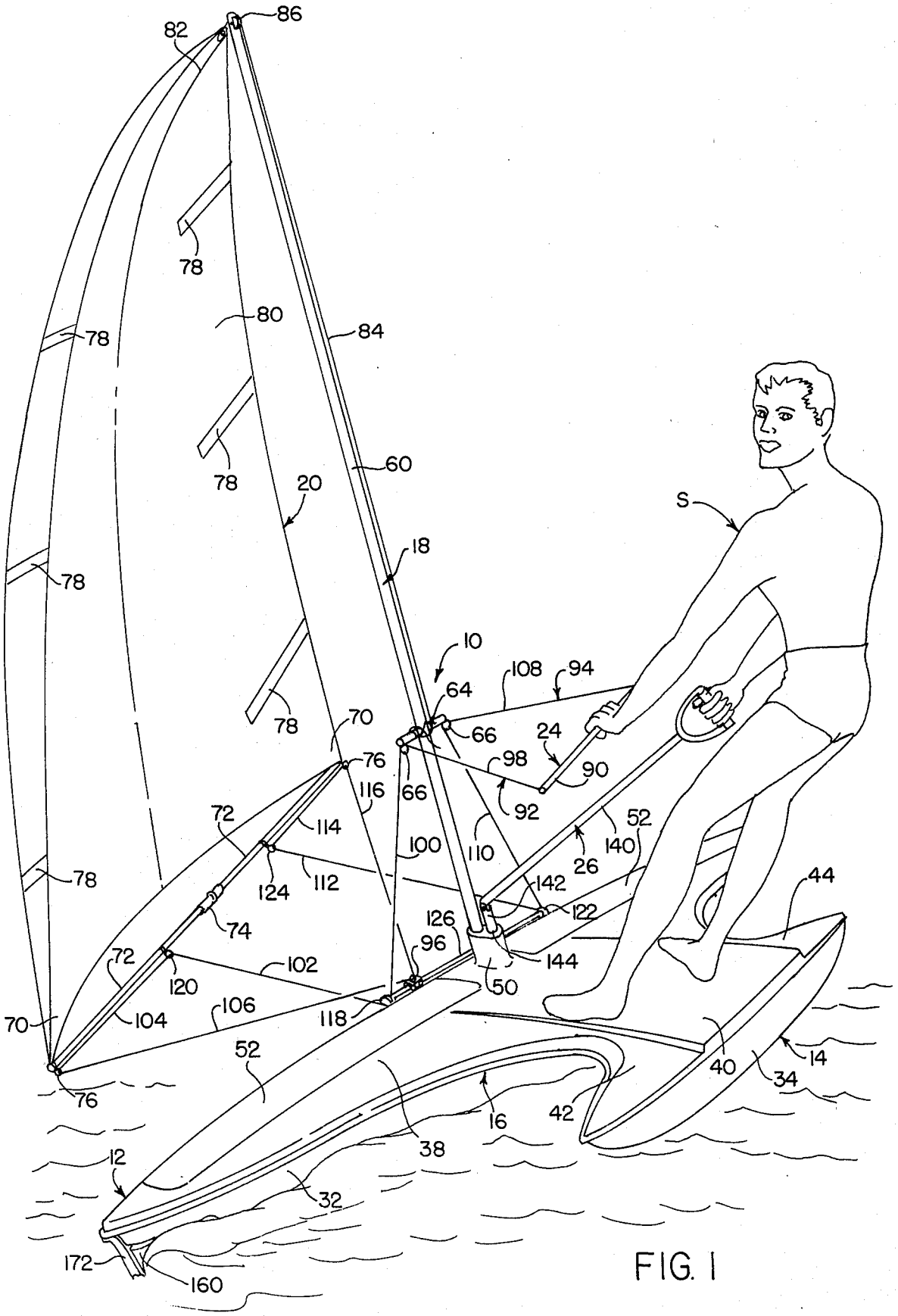

The web platform 40, particularly as illustrated in FIG. 1, rises at a slight angle from the plane of the upper surface of the upper section 38 adjacent the mast step to a somewhat elevated attitude adjacent the outer peripheral edge of the outboard pontoon 14. It will be recognized by persons skilled in the art that the web platform area 40 illustrated in FIG. 5 will rise to a somewhat higher attitude when the boat is placed in the water because the displacement of the outboard pontoon 14 in water is and will be much less than that of the main hull 12. When a person of average weight using the boat, approximately 160 pounds, stands, kneels or sits on the platform 40, there will of course be a lowering of the outboard pontoon in the water so that the upper surface of the platform will be somewhat lower than without such load. However, when wind force engages the sail, the outboard pontoon 14 will rise in the water and the platform surface assume a greater inclination to the horizontal plane.

The mast 18 comprises the mast pole 60, the lowermost portion 62 of which is supported within the bore or opening 64 of the step or housing 50 secured to the upper section 38. The mast pole 60 is also provided with a crossbar or member 64 to the ends of which are mounted sheet or line blocks 66,66. Adjacent the top of the mast pole is a rotatable pulley or block 86 rotatably mounted in a slot cut through the mast pole, or alternatively suspended from the pole, for a halyard 84, one end of which is provided with a fitting to releasably engage the sail apex 82 at a grommet affixed thereto.

The sail 20 is generally parabolic in shape, the boom 22 extending between the sail's lower end portions 70,70 which are connected in any suitable manner to the outer lateral ends of the boom members 72,72, conjoined in longitudinal aligned posture by the coupling 74. Sheet or line blocks 76,76 are affixed to the distal ends of the boom members 72,72. Inwardly directed battens 78 are disposed along the vertical depending edge portions of the sail body 80 to stiffen the sail at these lateral edges. The upper apical end 82 of the sail is connected to the halyard 84 which runs over the block 86 adjacent the upper end of the mast pole 60, the other end of the halyard being removably secured to a cleat 88 fixedly mounted on the mast pole, or to the crossbar 64, or to the deck of the main hull, or to any other suitable member, for ready access to the sailor whereby he can easily and effectively release the sail 80 from an operative wind-contact posture to an inoperative posture.

The sail control mechanism 24 comprises the manually manipulated sail control lever 90, the two sheet lines 92 and 94 which are secured to the control lever 90 adjacent its ends, and a plurality of blocks upon which the lines run from the lever 90. Each sheet line is composed of elements which engage the sail boom 22 and each line is secured at its opposite end to a slide member or carrier 96. Each of the sheets 92 and 94 is integrally formed of suitable and conventional line material and comprises the following portions as they pass through the blocks, in sequence. The sheet line 92 comprises the portions 98, 100, 102, 104 and 106, the distal end of which is fixedly secured to the slide member or carrier 96. The sheet line 94 comprises the portions 108, 110, 112, 114 and 116, the distal end of which is fixedly secured to the slide member or carrier 96. The sheet line 92 is movable upon the blocks 66, 118, 120 and 76, in sequence, as it is drawn or released by movement of the sail control lever 90. The sheet line 94 is operable upon the blocks 66, 122, 124 and 76, in sequence, as the sail control lever 90 causes it to move. The slide member or carrier 96 is slidable upon a rod or guide member 126 having downturned leg members 128,128 secured in bosses 130,130 integrally formed in or otherwise suitably affixed to the upper section 38 of the main hull. The blocks 118 and 122 are affixed to the main hull upper section 38, and the blocks 76,76, 120 and 124 are affixed to the boom members 72,72. The slide member or carrier 96 slidably engages the slide rod 126, securing the sheets 92,94 to the main hull.

The rudder steering mechanism 26 comprises the manually operated steering lever 140, the proximal end of which is pivoted at pin 141 upon the shaft 142 for vertical movement, the shaft 142 being mounted for rotation in the bore 143 of the mast step or housing 50, a pair of upper and lower bearings 144 and 146 respectively above and below the mast step 50, and a medial lever 148 fixedly secured to the distal end 150 of the shaft 142, so that when the steering lever 140 is rotated in a relatively horizontal path, the medial lever 148 will rotate horizontally in the corresponding direction. Two pairs of rudder steering lines are affixed to the ends of the steering lever 148. As will be seen more clearly in FIGS. 10 and 11, the rudder steering lines 152 and 154 extending to the left of the medial lever 148 are arranged in parallel and are connected to the ends of that lever. The distal ends of these lines are connected and affixed to the ends of the rudder lever 156 for rotation of the rudder shaft 158 supporting the rudder 160 affixed thereto and depending therefrom. To the right of the medial lever 148 and connected to its ends are the rudder steering lines 162 and 164 whose distal ends are connected to the ends of the rudder lever 166 for rotation of the rudder shaft 168 supporting the rudder 170 depending therefrom. The rudder steering lines 162 and 164 are not in parallel but cross each other in their course between the medial lever 148 and the rudder lever 166. This cross-over is required in order that the rudders 160 and 170 rotate in opposite directions when the medial lever 148 is rotated on its shaft 142 by the control lever 140.

As a protective bumper for the rudders 160 and 170, a bumper rod or strut 172 is aligned with and spaced slightly forward of the leading front edge and slightly below the lower edge of the rudder, the upper end of the bumper rod being affixed at one end thereof to the main hull underbody 32 adjacent its forward edge, and affixed at its other end to the lower edge of the underbody 32. Thus, the struts 172,173 provide protection to the rudders 160 and 170 against damage or interference with ground planes and objects when the rudders are in longitudinal alignment. Screws or other suitable fastening means can be used to secure the struts to the underbody.

The rudders 160 and 170 are also provided with lower pivot pins 174, 176 affixed to the rudders and aligned axially with their respective rotatable shafts 158,168. The upper portions of these pivot pins are secured to the rudder body and depend therefrom to rotate in complementary bores or counterbores disposed in the struts 172,173.

Operation

The sailboat 10 is operated by the sailor S in the following manner. The sail 80 is first secured at its lower corners 70,70 to the outer ends of the boom 22 which, though shown in two segments 72,72, can be made as a single integral member. Once the lower portion of the sail is secured to the boom, the proximal end of the halyard 84 is secured to the sail's apical end 82 by conventional means, such as a snap-type catch or other suitable fastener, and the halyard drawn over and down upon block 86, raising the sail to the upper end of the mast pole 60. The halyard is then secured about the cross member 64, or to any other suitable means such as a cleat which may be mounted on the mast pole or upon the deck in a position accessible to the sailor S.

If the wind is very strong, the sail control lever 90 can be eased, allowing the sail to draw the sheet lines 92,94 outwardly and to swing freely away from the boat, spilling the wind, and dissipating the wind pressure that may capsize the craft. Subsequently, if required the halyard 84 can be released, allowing the sail to fall from the mast. If the boat capsizes and the sail goes into the water, it is much easier to raise the boat to its normal float position if the sail is not engaged upon the mast pole, and this is one reason for arranging the halyard in such a way that it can be quickly and effectively released. Once the boat has been brought to normal upright position, the halyard 84 can be brought around the block 86 and the sail 80 raised to normal sailing position again.

With the sail 80 raised to the top of the mast pole 60, the sailor, standing upon the platform 40, grasps the sail control lever 90 in one hand and the handle of the rudder steering control rod 140 by his other hand. Upon drawing the sail control lever 90 toward himself, the sailor brings the sail boom 22 and sail 80 closer to the slide guide rod 126, and upon easing the sail control lever 90 toward the mast pole 60, the sail boom and sail are allowed to float or be carried away by the wind from the main hull 12. Such freedom of movement of the sail permits it to be more readily rotated about the slide member or carrier 96 which moves upon and along the slide rod 126 between its legs 128,128 secured in the bosses 130,130.

Steering is effected primarily by the rudder control mechanism 26. The general direction of the boat is determined by the sail control mechanism 24, comprising the sail control lever 90 and the sheet lines 92,94 which cause the sail to rotate with respect to the mast pole 60 toward the one side or the other of the pole, the slide member or carrier 96 moving along the slide guide rod 126 in accordance with the horizontal rotation of the sail control lever 90 as it is manipulated by the sailor.

Upon reference to FIG. 7 of the drawings, rotation of the sail control lever 90 in a counter-clockwise direction, i.e., drawing the distal end of the sheet line 92 toward the sailor and allowing the sheet line 94 to move further away from him, will result in the left end of the sail boom 22 being drawn inwardly toward the main hull 12 while the right end of the boom is allowed to move away from the main hull. At the same time, the slide member or carrier 96 will move and is drawn along the slide guide rod 126 toward its left end. As the sail rotates to the left side of the mast pole 60, the boat will be caused to move, or continue moving in the general direction to the left of the sailor.

To swing the sail 20 in the opposite direction, the sail control lever 90 is rotated horizontally clockwise, the sailor drawing the sheet line 94 toward himself and allowing the sheet line 92 to move further away. This movement causes the carrier 96 to slide along the rod 126 toward its right end, and the sail 80 to rotate clockwise about the mass pole 60 into the posture illustrated in FIG. 8. The boat will now move, or continue moving in the general direction to the right of the sailor. The boat 10 sails in either direction, to the left or right of the sailor.

The rudders 160 and 170 together with the rudder steering mechanism 26 substantially control the course of the boat 10. The rotative or pivoting movement of the sail 80, controlled by the sail control mechanism 24, supplements, and implements the steering function of the rudder steering mechanism 26 illustrated in FIGS. 10 and 11. The sailor is free to pivot the rudder control lever 140 in a vertical path upon the pivot pin 141 to any desired extent without rotating the shaft 142 to which it is connected. This movement enables the sailor to brace and balance himself comfortably upon the platform 40 and yet maintain steering control of the rudders. By swinging the rudder control lever 140 in a generally horizontal clockwise direction (FIG. 10), the steering lines 152, 154 and 162, 164 will effect rotation of the rudders 160 and 170 upon their respective pivoting shafts 158 and 168 in opposite directions, whereby the boat will take a course generally defined by an arcuate line drawn through the planes of the two rudders. The cross-over of the steering lines 162 and 164 effect this complementary relationship of the rudders. To control the rudder steering for movement of the boat in the opposite direction, as illustrated in FIG. 11, the rudder control lever 140 is rotated about the axis of the shaft 142 in a counter-clockwise direction causing the lever 148 to rotate counterclockwise, and the rudders 160 and 170 are now aligned in a path defined by the arcuate line passing through the planes of the two rudders.

The main hull, web and platform section and the outboard pontoon are preferably made of plastic or similar composition materials, suitable for use in water and having high tensile and compressive strengths. The rudder cable lines are preferably made of a twisted stainless steel cable material having substantial resistance to corrosion and elongation. Securement of these cable lines to the several levers can be effected by the use of conventional fasteners or fastening means well known in the art. The mast, the sail control lever 90 and the rudder control rod 140 can be made of wood or metal tubing, the sheets or sail control lines of conventional sheet cord material, and the sail and battens of conventional sail and batten materials such as canvas, nylon, other sheet plastics, etc., all suitable for use on boats or watercraft.

The sport boat of this invention has some distinct advantages. The provision of an outboard pontoon for a main hull with a connecting web and platform section provides adequate space upon which the sailor can stand, kneel or sit to control the sailing and steering functions of the boat without losing control of the sail. If the sailor stands on the platform 40, he braces himself with the rudder control lever 140 manually grasped by one hand, permitting himself to move toward or away from the mast pole 60 while manipulating the sail control lever 90 by his other hand. The sailor need not move from the platform 40 in order to operate and steer the boat.

Control of the sail 80 is normally effected by the sail control mechanism 24 from the lever 90 manually manipulated by the sailor. Should heavy gusts of wind apply such pressure to the sail that its control is difficult, the sailor can simply ease the sail control lever 90 forwardly, allowing the sheet lines 92 and 94 to run outwardly to the boom so that the sail 80 is free to swing about from its pivoting connection at the top of the mast pole and spill the wind to one side or the other, relieving itself of wind pressure and permitting the boat to remain upright. Should the force of the wind bearing upon the sail increase in force to an extent indicating that it will capsize the boat, the sailor can readily ease the sheet lines forwardly and then disengage the sail halyard 84 allowing it to run free upon the block 86 and the sail to fall freely onto the boat deck, if the sheet lines 92,94 are drawn inwardly at the same time, or to fall into the water, relieving it of wind pressure and permitting the boat to remain substantially upright upon the water. Once the wind force subsides sufficiently, the halyard 84 can be redrawn upon the block 86, raising the sail to an elevated posture adequate to again effectively move the boat upon a desired course.

Although a particular embodiment of the invention has been disclosed herein for purposes of explanation, further modifications or variations thereof, after study of this specification, will or may become apparent to those skilled in the art to which the invention pertains.

Reference should be had to the appended claims in determining the scope of the invention.

I claim:

1. In a sailing craft, the improvement comprising in combination a unitary lower section comprising a main hull, an outboard pontoon and an intermediate web and platform portion, a unitary upper section comprising the cover for said main hull, outboard pontoon and intermediate web and platform portion, said unitary lower and upper sections being conjoined at their peripheral edges to form a unitary main hull, outboard pontoon and intermediate web and platform structure, a single sail and mast for said craft, said mast being fixedly mounted and supported upright upon said main hull substantially medially of its length, said sail being removably and pivotally secured to said mast adjacent the upper end of said mast and depending and extending downwardly upon that side of said mast remote from said outboard pontoon, a boom secured to and extending across the lower portion of said sail free of contact with said mast, manually operable sail control means connected to said boom to pivot said sail from said mast upper end, rudder means for said craft pivotally mounted for rotation upon said main hull at each longitudinal end thereof, and substantially in a plane passed through the longitudinal axis of said main hull, and manually operable rudder control means on said main hull connected to said rudder means.

2. The sailing craft defined in claim 1, wherein said conjoined unitary upper and lower sections define a substantially air-filled chamber therebetween.

3. The sailing craft defined in claim 1, wherein said unitary conjoined structure has a substantially high degree of flotation.

4. The sailing craft defined in claim 1, wherein said rudder means comprises in part a rotatable rudder depending from and at each end of said main hull.

5. The sailing craft defined in claim 4, wherein said main hull is further provided with a rudder bumper secured thereto and disposed and spaced slightly forwardly of and below the leading and lower edges of each said rudder to safeguard the same against damage.

6. The sailing craft defined in claim 5, wherein each said rudder has a shaft affixed thereto rotatably mounted in said main hull for substantially horizontal rotation of said rudder.

7. The sailing craft defined in claim 5, wherein each said rudder has a pivot pin affixed thereto axially aligned with said rudder shaft, said rudder pivot pin being rotatable in said rudder bumper.

8. The sailing craft defined in claim 6, wherein said rudder shafts are rotatably mounted in bearings disposed in said main hull.

9. The sailing craft defined in claim 1, wherein said unitary upper and lower sections are made of a moldable plastic or composition material.

10. The sailing craft defined in claim 2, and wherein said unitary upper section of said main hull is provided with longitudinally aligned recesses and openings therethrough on either side of said mast for access to said chamber therebelow.

11. The sailing craft defined in claim 10, and wherein said unitary upper section of said main hull is further provided with cover plates adapted to seat in said recesses and above said openings to close said chamber therebelow.

12. The sailing craft defined in claim 1, and wherein said unitary upper section main hull portion is further provided with a mast step secured thereto for receiving and securing the lower end portion of said mast.

13. The sailing craft defined in claim 11, and wherein said mast step further provides means to support a portion of said rudder control means.

14. The sailing craft defined in claim 1, wherein said unitary upper section intermediate web and platform portion comprises a standing, kneeling or sitting platform for a craft operator, said platform being inclined upwardly from a line adjacent said mast on said main hull to a line adjacent the outer perimetric edge of said outboard pontoon.

15. The sailing craft defined in claim 1, wherein said sail is substantially triangular in configuration, the apex of said sail being normally secured adjacent said mast upper end.

16. The sailing craft defined in claim 15, wherein said boom extends across said sail lower portion between the corners thereof and is attached at least to said corners.

17. The sailing craft defined in claim 16, wherein said boom and sail are free to pivot from said mast upper end out of engagement with said mast.

18. The sailing craft defined in claim 15, and wherein said sail is provided with a halyard removably secured to said sail apex, means for mounting said halyard upon said mast upper end for facile elevating and lowering of said sail, and means for securing said halyard when said sail is elevated to maintain said sail at a desired elevation.

19. The sailing craft defined in claim 1, wherein said outboard pontoon is substantially shorter in length than said main hull.

20. The sailing craft defined in claim 1, wherein said sail control means comprises a sail control lever, sheet lines, a carrier and a slide rod for said carrier.

21. The sailing craft defined in claim 20, wherein said sail control member is manually manipulatable.

22. The sailing craft defined in claim 20, wherein said sheet lines are fixedly connected at one end to said sail control member, intermediately engaged with said sail boom, and fixedly connected at their other end to said carrier.

23. The sailing craft defined in claim 20, wherein said slide rod is disposed on said main hull longitudinally thereof, relatively adjacent said mast and extending to either side thereof, said carrier being slidable on said slide rod to carry said other end of said sheet lines to either side of said mast as said sail control lever is manipulated.

24. The sailing craft defined in claim 23, wherein said slide rod is fixedly secured to said main hull adjacent the outboard edge of said main hull.

25. The sailing craft defined in claim 8, and wherein said rudder control means comprises a manually manipulatable rudder control lever pivotable at its proximal end upon a control lever shaft bearing-mounted in said main hull, a medial lever secured medially thereof to said rudder control lever shaft, a rudder lever secured medially thereof to each of said rudder shafts, and steering lines connecting said medial lever to each of said rudder levers.

26. The sailing craft defined in claim 25, wherein said steering lines comprise a pair of lines in parallel connecting said medial lever to one said rudder lever, and a pair of crossed lines connecting said medial lever to the other said rudder lever, whereby said rudders are rotated in opposite directions upon rotation of said control lever shaft by said rudder control lever.

27. The sailing craft defined in claim 1, wherein said sail is substantially parabolic in configuration, the apex of said sail being normally secured adjacent said mast upper end.

* * * * *